United States Patent [19]

Watson et al.

[11] 3,967,960

[45] July 6, 1976

[54] PHOTOELECTROPHORETIC IMAGING PROCESS EMPLOYING DARK CHARGE INJECTING ELEMENT

[75] Inventors: P. Keith Watson, Rochester; Paul J. Cressman, Fairport; Richard V. LaDonna, Irondequoit, all of N.Y.

[73] Assignee: Xerox Corporation, Stamford, Conn.

[22] Filed: Oct. 21, 1974

[21] Appl. No.: 516,702

[52] U.S. Cl. ..... 96/1 PE; 96/1.2; 104/181

[51] Int. Cl.[2] ..... G03G 17/04

[58] Field of Search ..... 96/1 PE, 1.2, 1.3

[56] References Cited

UNITED STATES PATENTS

| | | | |
|---|---|---|---|
| 3,511,651 | 5/1970 | Rosenberg | 96/1.5 |
| 3,535,221 | 10/1970 | Tulagin | 96/1 PE X |
| 3,595,771 | 7/1971 | Weigl | 96/1.3 |
| 3,620,948 | 11/1971 | Walsh | 96/1 PE X |
| 3,676,313 | 7/1972 | Ciccarelli | 96/1 PE X |
| 3,689,399 | 9/1972 | Ota | 96/1 PE X |
| 3,689,400 | 9/1972 | Ota et al. | 96/1 PE |
| 3,767,392 | 10/1973 | Ota | 96/1 PE |
| 3,804,620 | 4/1974 | Wells | 96/1.3 |
| 3,850,627 | 11/1974 | Wells et al. | 96/1.3 |

*Primary Examiner*—David Klein
*Assistant Examiner*—John R. Miller
*Attorney, Agent, or Firm*—James J. Ralabate; Michael H. Shanahan; Gaetano D. Maccarone

[57] ABSTRACT

An improved photoelectrophoretic imaging method is disclosed wherein the imaging suspension is brought into contact under a first electrical field with a blocking layer having a coating which interacts, in the dark, with the pigment particles of the imaging suspension so as to provide a uniformly charged imaging suspension. The imaging suspension is then exposed to appropriate electromagnetic radiation while under a second electrical field. A second blocking layer, free of said coating is employed to produce positive and negative images.

22 Claims, 6 Drawing Figures

PHOTOELECTROPHORETIC IMAGING PROCESS EMPLOYING DARK CHARGE INJECTING ELEMENT

BACKGROUND OF THE INVENTION

This invention relates to the photoelectrophoretic imaging process and more particularly to an improved process wherein the imaging suspension is uniformly charged.

A detailed description of the photoelectrophoretic imaging process and materials and apparatus therefore appears in U.S. Pat. No. 3,383,993; 3,384,488; 3,384,565 and 3,384,566. The disclosures of the aforementioned patents are hereby incorporated by reference. Briefly, the photoelectrophoretic imaging process, as described in the aforementioned incorporated patents, is a method wherein a liquid suspension of electrically photosensitive particles is placed between a pair of electrodes. The particles acquire a charge when an electrical field is placed between the electrodes which charge is modified by exposure of the particles to light thus causing a light controlled deposition of the particles on one boundary of the suspension or the other. Particle movement is caused by the force exerted on the charged particles by the electric field. The light absorbed by a particle enables it to undergo a change in polarity which then determines its position in the field. One of the electrodes in the process is termed a conductive electrode which is generally a transparent conductive material and is the electrode upon which the pigments desirably rest at the time they are exposed to appropriate electromagnetic radiation. While not subscribing to any particular theory, the aforementioned patents propose that the pigments when exposed to actinic electromagnetic radiation while resting upon the conductive electrode, acquire a charge from the electrode. Upon acquisition of such charge the particle moves toward the opposite electrode. The opposite electrode is generally covered with an electrically insulating material such that when a pigment particle contacts the electrode under influence of the field it will not give up any charge and will remain against the blocking electrode. Upon separation of the electrodes there is generally provided an optically positive image on one of the electrodes and a negative image residing on the electrode either monochromatic or polychromatic depending upon the optical input and the colors of the pigments in the imaging suspension.

As previously mentioned, the pigments in the imaging suspension have an initial charge and also can acquire an additional electrical charge upon being subjected to an electrical field between the electrodes. One of the problems encountered in the above-mentioned process relates to the polarity of the charge acquired by the pigments of any one color. For example, while about half of certain magenta pigment particles may exhibit a negative charge in the field between the electrodes while in the dark, the other half of the pigment particles will acquire the opposite charge and thus migrate immediately, in the dark, to the blocking electrode. Thus because only some of the pigment resides on the conductive electrode, the density of the resultant image on the conductive electrode is reduced by the amount of pigment deposited on the blocking electrode. Another disadvantage of this phenomenon is the unwanted deposition on the blocking electrode of such pigments in background areas thus degrading image quality of both images produced by the process.

The problem of non-uniform charging of the pigments in the imaging suspension of the photoelectrophoretic imaging method is well known and, in fact, has been employed advantageously in the prior art. For example, a photoelectrophoretic imaging system taking advantage of the diversity of the dark charge of the pigments is disclosed in U.S. Pat. No. 3,535,221, to Tulagin. In accordance with the system disclosed therein the image sense, optical positive or optical negative, is controlled such that one may produce a positive image or a negative image on either of the blocking electrode or the conductive electrode. The method of selectively producing positive or negative copies on either electrode is achieved by providing an imaging suspension with pigment particles having a sensitivity to a first range of wavelengths and providing on the blocking layer surface a photosensitive material sensitive to a second range of wavelengths. In accordance with the disclosure of that patent an optically positive image is formed on the blocking electrode by exposing the suspension and blocking layer to light in wavelength to which only the coating on the blocking layer is sensitive. If one desires to produce an optically positive image on the conductive electrode one exposes the imaging suspension to electromagnetic radiation to which the particles of the imaging suspension are sensitive but to which the material on the blocking is insensitive. The positive image is formed on the blocking layer because of the diversity of charge acquired by the particles of the imaging suspension in the dark. Some of the imaging pigments are attracted to the blocking electrode to form a coating of imaging pigment particles. When the material on the blocking layer is exposed to actinic radiation the pigment particles of the suspension are repelled from the blocking layer in the exposed areas. According to the patent, the coating on the blocking layer reflects back any pigment attracted to it when the coating on the blocking layer is struck with light to which its coating is sensitive. Thus the light exposed areas will contain no pigment while there will reside on the blocking electrode in non-light struck areas a coating of imaging pigment which has taken an opposite charge to those coating the conductive electrode. When the imaging suspension is exposed with light to which it is sensitive, but to which the coating on the blocking layer is insensitive, the imaging pigments coating the conductive layer are caused to migrate to the blocking electrode in the exposed areas. There is thus produced a positive image configuration of the imaging particles on the conductive electrode.

An even more severe problem exists with polychromatic images produced by the aforementioned process because the loss of varying amounts of pigments of the different colors in this suspension destroys the color balance intended to produce the desired final result.

We have previously discovered a method for improving the photoelectrophoretic process which involves uniformly charging the pigments in the imaging suspension. We have found that certain materials, when coated on the blocking layer employed in the imaging process, inject charge into the pigments of the imaging suspension while in the dark to provide a uniformly charged pigment layer. However, operating conditions for the exposure step of the imaging process are not necessarily optimum for the process of dark charge injection and thus a separation of the processes is desirable.

SUMMARY OF THE INVENTION

Now in accordance with the present invention, it is an object to overcome the above-noted deficiencies in the prior art photoelectrophoretic imaging process.

More specifically, it is an object of this invention to provide a photoelectrophoretic imaging process wherein all of the pigments in the imaging suspension are charged to the same polarity while in the dark and prior to imagewise exposure by means of dark charge injection under a first electric field and imagewise exposed to appropriate electromagnetic radiation under a second electric field.

Another object of this invention is to provide a photoelectrophoretic imaging process wherein images having improved density are produced.

Yet another object of this invention is to reduce the unwanted background material resulting from non-uniform charge acquisition of pigments in the photoelectrophoretic imaging system.

In accordance with this invention there is provided a photoelectrophoretic imaging process wherein all of the pigments in the imaging suspension are charged in a first electric field, in the dark, to a common polarity by means of a dark charge injecting material which is in contact with the imaging suspension.

Subsequent to said charging the imaging suspension is subjected to a second electrical field and exposed to electromagnetic radiation to which at least some of the pigments are sensitive while in contact with a blocking layer free of dark charge injecting material. A dark charge injecting material is any material, as further described below, which will inject charge of one polarity into all the pigments of the imaging suspension. The dark charge injecting material need not be photosensitive or if photosensitive, it need not be of the same or of different sensitivity as the pigments in the imaging suspension. The reason for the disregard of sensitivity is because the effect of the injection occurs in the dark or, in other words, in the absence of electromagnetic radiation to which either the dark charge injecting layer or imaging suspension is sensitive.

Surprisingly, we have discovered that upon the employment of a first electrical field for the purpose of uniformly charging the pigments of the imaging layer by dark charge injection and a second electrical field for the purpose of exposing the imaging layer to appropriate electromagnetic radiation, the imaging speed of the pigment particles is increased. That is, the obtainable imaging speed of the pigments is greater in the process of this invention than is obtainable in the process wherein only one electrical field is employed to both dark charge inject the pigment and imagewise expose them to the appropriate magnetic radiation.

As will be disclosed herein below, many electrically photosensitive pigments useful in the photoelectrophoretic process possess some degree of dark charge injection ability and can be employed as the coating on the blocking layer for this purpose. In the preferred embodiment of this invention, the dark charge injecting ability of the pigments in the imaging suspension is very low. This condition is attained by careful selection of pigments which possess no or very little dark charge injecting ability or by pretreating the pigments so as to reduce or eliminate their ability to dark charge inject. One preferred pretreatment is to coat the pigment with a thin coating of an electrically insulating resinous material, such as polyethelene.

In accordance with the method of this invention, a dark charge injecting material is provided on the blocking layer by either first coating the blocking layer by any suitable means as described herein below or including a dark charge injecting material in the imaging suspension. Prior to imagewise exposure, the imaging suspension containing the dark charge injecting material is subjected to a first electrical field, whereby the dark charge injecting material is caused to migrate to the blocking layer where it remains because of the polarity of the charge the material acquires by being subjected to the electric field. On the blocking electrode the dark charge injecting material performs the function of charging the pigments intended for use in the imaging process to a uniform polarity. The uniform polarity to which the pigments are charged is such as to cause these pigments to deposit on the conductive electrode in the dark. The uniformly charged imaging layer is then exposed to appropriate electromagnetic radiation and a second field imposed on the layer while it is in contact with a blocking layer free of dark charge injecting material.

Exerience with the method of this invention has shown that the polarity injected into the imaging pigments of the imaging suspension by the dark charge injecting material is that polarity which is the same as the blocking electrode. For example, if the blocking electrode has a negative polarity with respect to the conducting electrode the dark charge injecting material will cause the pigments of the imaging suspension to become negatively charged thus causing them to be attracted to the positive conductive electrode prior to the exposure step of the process of this invention.

The materials useful in the process of this invention for the purpose of causing a charge to be injected into the pigments while in the dark condition depends upon the pigments employed in the imaging suspension. Dark charge injecting materials can be classified with respect to their ability to dark charge inject so as to form a Dark Charge Injection Series by an electrometer measurement further described below. In accordance with this invention, the dark charge injection material in contact with the imaging suspension need only be at least as high in the series than the pigments employed in the imaging suspension.

Previously, an excess of dark charge injection into the pigments of the imaging suspension in accordance with this invention will decrease the photosensitivity of the pigments. In some cases, the decrease would be to the point to making a reasonable image exposure impractical. To regulate the amount of dark charge injection, one would regulate the amount of dark charge injecting material employed on the blocking layer and if such material is highly active, then the amount was decreased so that the dark charge injection would be adequate to provide a uniformly charged imaging suspension, but would not unduly reduce the photosensitivity of the pigments.

In accordance with the present invention, there is less need to regulate the effectiveness of the dark charge injecting material on the blocking layer because of the use of two different electrical fields in the imaging process. The blocking layer now employed during second field and exposure step is free of dark charge injecting material. The electrical field employed during the imagewise exposure step is now adjusted so as to be optimum for the condition of the pigments which have been subjected to the dark charging injection process by the first electrical field. In turn, the first electrical field is adjusted so as to be optimum for the dark charge injecting step. The amount of applied voltage during the dark charge injecting step now need not be the same as that employed during the imagewise exposure step of the process. In fact, the electrical field in the gap, between the blocking and injecting electrode is actually higher during the imaging step in the process of this invention although both the first and second fields are created by the same voltage applied to the electrodes.

Any candidate material can be placed in the Dark Charge Injection Series by means of a simple test. According to the test, as is more fully described below, the candidate material is coated onto a blocking electrode and mounted on a roller electrode. A thin layer of electrically insulating liquid is spread over a conductive electrode. The electrodes are then connected to a source of electrical potential in the range of about 800 to about 1,000 volts and the roller passed over the conducting electrode at a speed of about 2–5cm./second. After the roller has passed over the conductive electrode with the potential applied, the amount of charge residing on the candidate material residing on the blocking layer is measured by an electrometer. The amount of charge remaining on the candidate material, expressed as voltage, determines the place the candidate material occupies in the Dark Charge Injection Series. The Series is arranged in terms of such voltage, with each candidate material being placed in the Series immediately above any other material providing a lower voltage in the test and below any other material providing a higher voltage value in the test.

In accordance with the above-mentioned test there is found in Table I below materials and test results providing an indication of the position of each material in the Dark Charge Injection Series. The test is operated at an applied voltage of 1,000 volts. In general, the amount of dark charge injection increases with the thickness of the layer of candidate materials. For illustrative purposes, data is shown below with the same material at three different thicknesses, each thickness providing a different result.

TABLE I

| Material Tested | Voltage |
|---|---|
| 2,3-dichloro-5,6-dicyano-1,4-benzoquinone | 960 |
| 1-[1-naphthyl azo-]-2-naphthol (1 micron thick) | 900 |
| benzo-[b]-naphtho-[2,3-d] furan-6,11 dione | 750 |
| naphtho [2,3-d] furo-[3,2-f] quinoline-8,13-dione | 560 |
| Bonadur Red B (a pigment available from Collway Colors, Inc.) | 500 |
| naphtho [2,3-d] furo-[2,3-h] quinoline-8,13-dione | 450 |
| 1-[1-naphthyl azo]-2-naphthol (.1 micron thick) | 400 |
| alpha phthalocyanine | 300 |
| dinaphtho [1,2,b; 2',3'd] furan-7,12-dione | 250 |
| dinaphtho [1,2b; 2',3'd] furan-8,13 dione | 100 |
| 1-[1-naphthyl azo]-2-naphthol (.01 micron thick) | 80 |
| Bonadur Red B* | 60 |
| N-2''-pyridyl-8,13-dioxodinaphtho-[2,1-b;2',3-d]-furan-6-carboxamide | 24 |

*The pigment is first dispersed in mineral oil at 4 grams per 100ml. About .8 grams of purified powdered polyethylene DYLT from Union Carbide Corporation is added and dissolved by heating the mixture to 105°C - 110°C. The solution is cooled thus coating the pigment particles with the polythylene.

Although this invention has been described with respect to the photoelectrophoretic imaging process, it is equally applicable to the electrophoretic imaging process. Because the dark charge injection does not require actinic electromagnetic radition and the electrophoretic imaging process can be advantageously employed with a dark charge injecting material on the blocking layer. Thus, typical prior art electrophoretic systems incorporating the dark charge injecting materials as described herein with respect to the photoelectrophoretic imaging process are within the scope of this invention.

BRIEF DESCRIPTION OF THE DRAWINGS

The invention may be further understood upon reference to the drawings which show a schematic representation of apparatus for performing the improved photoelectrophoretic imaging process of this invention.

DETAILED DESCRIPTION OF THE DRAWINGS

Figure 1A:
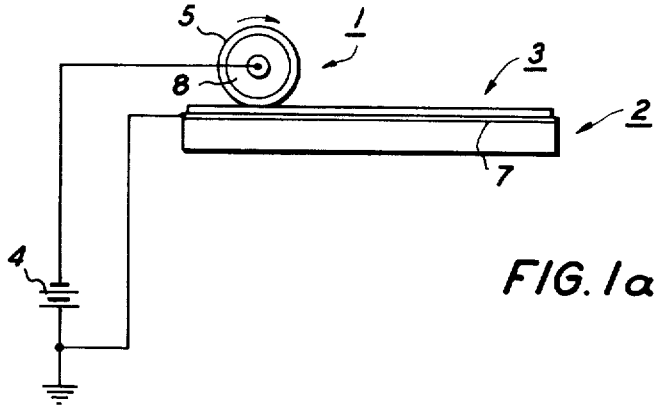
FIG. 1*a* is a schematic, side elevation view of a system for dark charge injecting the imaging suspension of a photoelectrophoretic imaging system.

FIG. 1*a* illustrates a conventional configuration for a dark charge injection process which includes the roller electrode 1, transparent conductive electrode 2 and the imaging suspension 3 containing photosensitive pigment particles. An electrical field is established across the suspension in the vicinity of the electrode nip by an appropriate electrical energy source 4. Roller electrode 1 carries electrically insulating blocking electrode 5 which is coated with a thin layer of dark charge injecting material. (not shown) By rolling the blocking roller electrode 1 across the imaging suspension 3, the pigments in the imaging layer are uniformly charged by the action of the electrical field and the dark charge injecting material on the blocking layer. This operation takes place in the dark or prior to exposing the pigments in the imaging layer to electromagnetic radiation to which they are sensitive.

Typically, the transparent conductive electrode 2 includes an optically transparent glass plate 6 coated on the imaging suspension side with an optically transparent layer of conductive material such as a thin layer of tin oxide 7. Electrodes of this type are typically termed "injecting electrodes" because the conductive layer provides an abundant source of charge carriers for exchanging charge with exposed photosensitive pigment particles of the imaging suspension. The roller blocking electrode 1 includes a conductive core 8 overcoated with a layer 5 of electrically insulating material. Electrodes of this type are typically termed "blocking electrodes" because the insulating layer provides few if any charge carriers for exchanging charge with photosensitive pigment particles residing thereon. The insulating layer 5 may be eliminated and photoelectrophoresis will still occur but its presence insures against electrical shortage between the electrodes in addition to improving image quality. Also, the transparent injecting electrode 2 may also be provided with a transparent electrically insulating layer over the tin oxide surface immediately adjacent to the imaging suspension because charge carriers can be made available to the exposed electrically photosensitive pigment particles fully in accordance with the prior art.

Figure 1B:
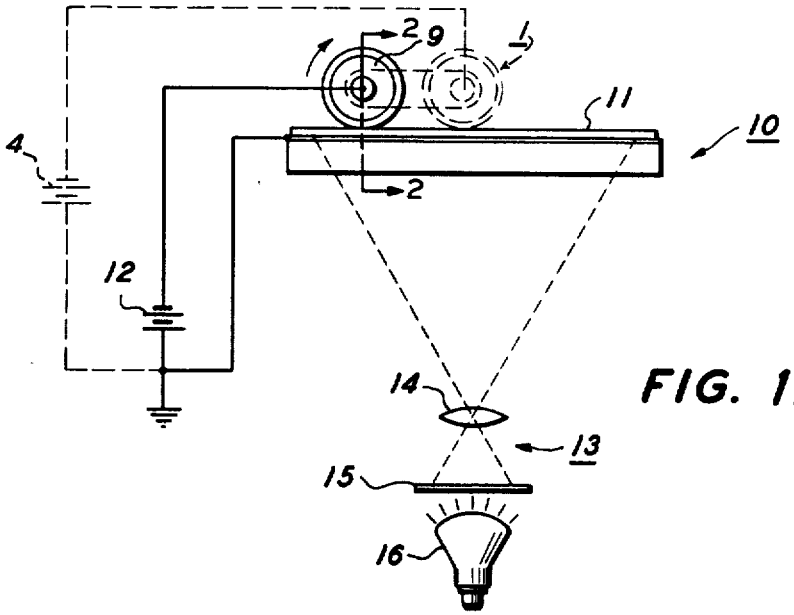
FIG. 1*b* is a schematic, side elevation of the exposure step of photoelectrophoretic imaging system.

FIG. 1*b* illustrates a conventional configuration for a photoelectrophoretic imaging system, which includes roller electrode 9 and conductive electrode 10 substantially as described above in FIG. 1*a* as roller electrode 1 and transparent conductive electrode 2. Imaging suspension 3 of FIG. 1*a* is now uniformly charged in accordance with this invention and is in the form of a layer 11 shown in FIG. 1*b* in greatly exaggerated proportions. An electrical field is established across the imaging layer 11 in the vicinity of the electrode nip by an appropriate electrical energy source 12. The imaging layer is exposed by the exposure mechanism 13 to electromagnetic radiation to which the electrically photosensitive pigments in the imaging layer 11 are sensitive. Mechanism 13 includes lens 14, which focuses a light image of the original 15 through the transparent injecting electrode 10 onto the suspension. An appropriate light source 16 generates the electromagnetic radiation. Typically, a full frame positive image is formed on the conductive electrode 10 and a full frame optically negative image is formed on the blocking layer of roller electrode 9. By rolling roller electrode 9 across the imaging layer 11, the image is formed in a line by line fashion as the roller electrode rotates and translates over the transparent electrode while the light and field are applied.

An alternative construction is shown in dotted line by FIG. 1*b* wherein a conductive roller 1, of FIG. 1*a* is attached to roller 9 by means of an insulated connection. Roller 1 carries the dark charge injection material on a blocking layer as described above. A first electrical field is applied by power source 4 thus providing a dark charge injecting step immediately prior to the exposure step. The first electrical field imposed between roller 1 and electrode 11 is independent of the second electrical field imposed between roller 9 and electrode 11. Because of the charges induced in the imaging pigments by the first electrical field, the second electrical field can be internally higher than the first although the voltage applied to rollers 1 and 9 are the same. Of course, in this alternative embodiment the exposure means 13 includes a slit scanning arrangement so as to direct, with no relative motion, an image pattern coincident with the forward nip of roller 9. Through the employment of a slit scanning device the image is projected in line by line fashion onto the imaging suspension as roller 9 travels across imaging layer 11. Thus, the dark charge injection step and exposure step are accomplished in rapid sequence.

Figure 2:
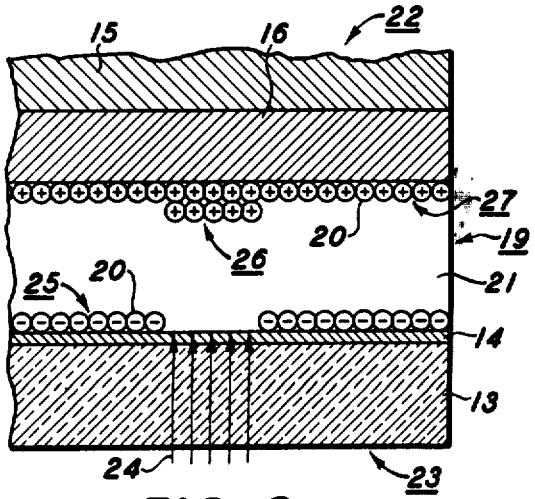
FIG. 2 is a schematic, sectional view in exaggerated proportions taken along lines 2—2 in FIG. 1*b* and illustrates the dark and light charged condition of prior art photoelectrophoretic systems which do not employ a dark charge injecting material on the blocking layer.

FIG. 2 illustrates the light induced image forming process of an exposed imaging suspension subjected to an electric field in accordance with the prior art that is, in the absence of a dark charge injection step in the imaging process. It should be understood that this and the other drawings are intended to convey a functional understanding of the photoelectrophoretic process and the present invention. The physical models represented in the drawings are directed to that and are not intended to be theoretical explanations of the physical and chemical mechanisms involved. The relative sizes of the electrodes, imaging suspension and pigment particles therein are not to scale but are greatly exaggerated. The above mentioned and incorporated patents may be consulted for greater detail in that regard. For example, the usual particle size in the imaging suspension is from about 0.01 to about 20 microns and the gap between the electrodes occupied by the suspension is typically in the order of about 1 mil. down to the thickness of the imaging layer 11 in combination with the liquid portion of the suspension not pushed out by the sqeegee action of roller electrode 9. Similar dimensions apply to the dark charge injection step described by FIG. 1*a*.

Suspension 19 of FIG. 2 includes the bipolar, electrically photosensitive pigment particles 20 and an electrically insulating liquid 21. The electric field established between electrodes 22 and 23 cause the positively charged pigment particles in the imaging suspension to be attracted toward electrode 22, which in this instance is taken to be negatively charged with respect to electrode 23. The negatively charged particles are thus attracted toward positively charged electrode 23. The amount or number of pigments attracted to the electrodes vary depending upon the nature, purity and type of pigments in the imaging suspensions. Although the distribution or particles is indicated to be approximately equal, such may not be the case in most instances. However, in many imaging suspensions of the prior art there are significantly high numbers of pigment particles which have too low a charge or are of the wrong polarity and hence are either not attracted at all or attracted to the blocking layer. The number is sufficiently high so as to substantially reduce the density of the particles layer on the conductive electrode 23. Lines 24 represent electromagnetic radiation of an image directed through transparent electrode 23 to the negatively charged pigment particles layer 25. Negative particles absorbing the radiation lose their excess charge and/or negative charge carriers to become positively charged and are thus attracted in the electric field toward negative electrode 22. The migrated particles 26 comprise an optically negative image of the original and the particles remaining on electrode 23 comprise an optically positive image of the original image. It is apparent from FIG. 2 that the pigment particles forming layer 27 on the blocking electrode 22 have remained there from the inception of the electrical field which attracted them. They remain there completely unaffected by the imaging operation. Thus, at least two disadvantages of their presence in layer 27 are evident. First, they deprive the positive image of their contribution in terms of color balance in the polychrome system and in both monochrome and polychrome they deprive the positive image on electrode 23 of their contribution toward the density of the resulting image. Secondly, layer 27 provides unwanted background particles on the negative image residing on the blocking electrode 22. Such background is undesirable as it detracts from the qualities of the images thus produced.

Prior attempts at eliminating layer 27 included separating the steps of forming particle layer 25 and exposing the layer. That is, a second blocking electrode roller having a clean surface is passed over layer 25 so that particles 26 are deposited on a particle-free surface. The problem with this technique is that the particles in layer 25 are not always stable and/or bipolar particles are still present in sufficient quantities to form a particle layer similar to layer 27 on the clean roller surface. Obviously, an undesired second step is required in the prior art and the inefficient use of materials must be tolerated.

Figure 3:
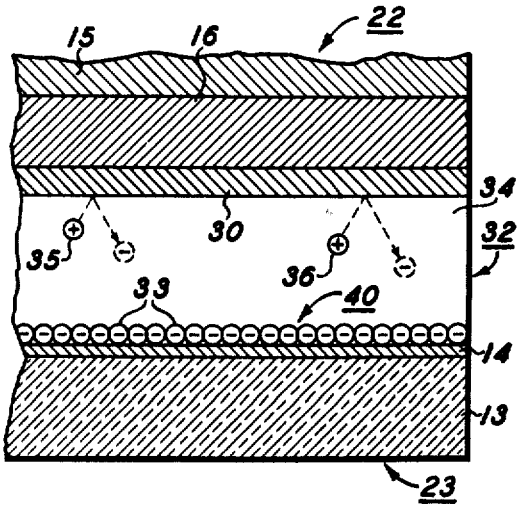
FIG. 3 is a schematic, sectional view in exaggered proportion taken along lines 2—2 in FIG. 1*b*, further including a dark charge injecting material on the blocking electrode in accordance with the process of this invention.

FIG. 3 illustrates a process of the present invention wherein the dark charge injecting material 30 resides on blocking layer 16. As explained previously, the application of an electric field between electrodes 22 and 23 causes the pigment particles of an imaging suspension to be attracted toward the electrode of opposite polarity to the charge acquired by the various pigment particles. Thus, layer 40 is formed on conductive electrode 23 which again is charged positively with respect to electrode 22 in the electrical field. The positively charged pigment particles of imaging suspension 32 are attracted toward negatively charged electrode 22. In FIG. 3 these are illustrated as particles 35 and 36 which upon coming in contact with the dark charge injecting material forming layer 30 become negatively charged and are thus attracted toward electrode 23 leaving the blocking layer free of pigment particle deposits. As mentioned above, the dark charge injecting material causes the pigment particles to acquire a charge of the same polarity as the electrode upon which the dark charge injecting material resides. The actual charge exchange mechanism is not presumed to be explained herein. Regardless of the mechanism involved, the positively charged particles become negative and join the originally negatively charged particles initially attracted to a transparent conductive electrode 23 to form layer 40. Ideally, all the particles in the suspension are attracted into and form layer 40 thereby increasing the potential maximum optical densities for the optical positive and negative images to be formed in the photoelectrophoretic imaging process. In addition, uniform deposition of the pigment particles increases the efficiency of the materials employed in the process and the color balance of a polychrome system is more easily achieved because one need not anticipate the loss of various amounts of differently colored pigments from the final image due to the erratic nature of charge acquisition of any one colored pigment in the imaging suspension.

Layer 40 is exposed in the conventional fashion as explained above with respect to the prior art photoelectrophoretic processes. A negative image is formed by particles attracted toward electrode 22 because of the action of appropriate electromagnetic radiation to which they are exposed as shown in FIG. 2. Of course, the negative image thus produced on electrode 22 does not contain undesirable background particles and the positive image remaining on electrode 23 benefits from the increased density otherwise lost by the previously positively charged pigment particles of the imaging suspension.

As explained above, materials useful for layer 30 are those materials which have at least an equal place in the Dark Charge Injection Series as any of the pigments employed in the imaging suspension. The choice of such materials for layer 30 are thus independent of properties such as their relative spectral sensitivity with the pigment particles of the imaging suspension. In fact, it has been found that layer 30 may comprise pigment particles which are also employed in imaging suspension 32. In addition, materials useful in Layer 30 can comprise materials which previously have been recognized as not possessing any electrically photosensitive properties and previously useless in prior art photoelectrophoretic imaging processes. The usefulness of any material can be easily determined by the above described secondary test which places the material in the Dark Charge Injection Series. Otherwise it is simply a matter of associating the proper electrically photosensitive pigments in imaging suspension 32 with the appropriate dark charge injecting for use in layer 30. In accordance with the above described secondary test a material which measures in the range of from about 200 volts to about 900 volts is normally satisfactory for use with most commonly available pigments in the imaging suspension of the photoelectrophoretic imaging process. Of course, the purity of a material may affect its activity as a dark charge injecting agent and care should be taken to provide reasonably uncontaminated materials.

The dark charge injecting materials of layer 30 can be applied to the blocking layer in many ways. The material can be dispersed in a carrier liquid and painted, dipped or rolled onto the surface of a blocking electrode. Upon drying, the dark charge injecting material is fixed to the blocking electrode such that it will not disperse into the imaging suspension during the photoelectrophoretic imaging process. The liquid employed in the imaging suspension should be coordinated with the dark charge injecting material on the blocking layer such that the liquid will not dissolve or loosen the dark charge injecting material on the blocking layer.

Another method for applying the dark charge injecting material is to include the material in the imaging suspension. Upon application of the electrical field, in the dark, the dark charge injecting material will plate out onto the blocking layer to form layer 30 and remain there during the imaging process. As mentioned above, evaporation of the dark charge injecting material with subsequent condensation on the blocking electrode is preferred because of the control capable of being exercised over the coating conditions resulting in a uniformly applied dark charge injecting layer on the blocking electrode.

Figure 4A:
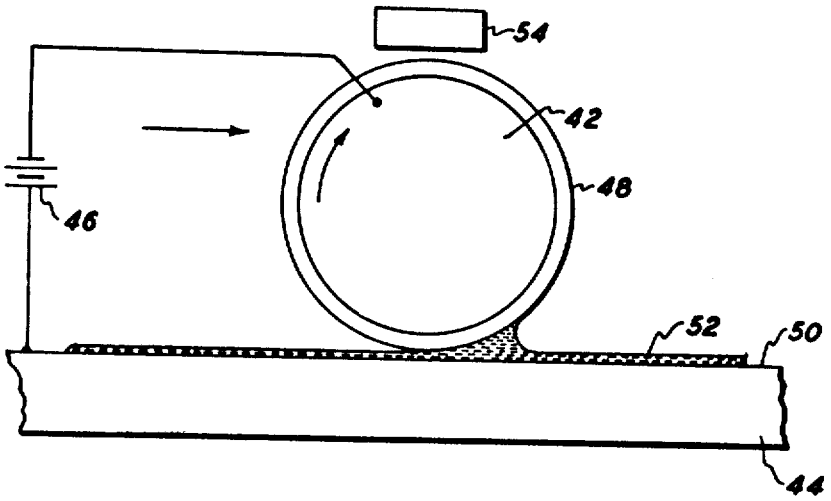
FIG. 4*a* is a schematic, side elevation view of a test system employed to place materials in the Dark Charge Injection Series.

As mentioned above, the Dark Charge Injection Series can be determined by a secondary test. In FIG. 4*a* there appears a schematic side elevation view of one system employed to place materials in the Series. A pair of electrodes, roller electrode 42 and conductive electrode 44, are connected to power source 46. Electrode 42 is coated with an electrically insulating blocking layer 48 which, in turn, carries a thin layer of the candidate material. (not shown) Liquid layer 52 is placed between blocking layer 48 and electrode 44. With the electric field placed between the electrodes, roller electrode 42 passes over liquid layer 52 while the system is in the dark. The candidate material on blocking layer 48 passes between the electrodes and is thus subjected to the above mentioned electric field while in the dark. Without offering any theoretical explanation, the candidate material will carry an electric charge subsequent to being subjected to the electric field as described above. The amount of charge, expressed in volts, is measured by an electrometer or electrostatic voltmeter probe 54.

Figure 4B:
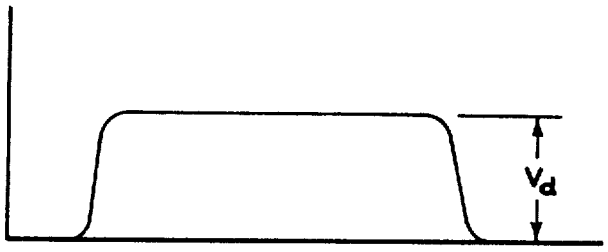
FIG. 4*b* is a graphical representation of data acquired by employing the system of FIG. 4*a*.

In FIG. 4*b* is presented a graphical representation of the charge measured by probe 54. The ordinate indicates voltage measured and the abscissa indicates circumferential distance of the candidate material on blocking layer 48. As shown in FIG. 4*b*, the amount of voltage $V_d$ indicates the dark injection voltage of the candidate materials.

Any suitable material can be placed in the Series. The electrometer test described above is utilized by first coating a blocking material to a suitable thickness with a candidate material. The most preferred blocking material is Tedlar, an aluminized polyvinyl fluoride available from the E. I. duPont de Nemours & Co., Inc., the coated blocking material is utilized as the blocking electrode in a roller configuration which can take the form of the system of FIG. 4*a*. The insulating liquid layer 52 is free of any pigment particles and can be any liquid previously known to be useful in the prior art photoelectrophoretic imaging system. A kerosene fraction, Sohio Odorless Solvent 3440 available from the Standard Oil Co., is the preferred electrically insulating liquid. The configuration comprising the coated blocking electrode 48, the clear liquid layer 52 and conductive electrode 44 is subjected to an electrical potential of about 1,000 volts. If the apparatus of FIG. 4*a* is employed, the roller blocking electrode traverses the conductive electrode at a rate of about 2–5 cm./second. The configuration is maintained in the dark condition while the electric potential is applied. The change, in voltage, is measured on the coated blocking layer is detected by electrostatic voltmeter 54 as the roller electrode 42 travels across conductive electrode 44. The amount of voltage measured determines the place the candidate material occupies in the Dark Charge Injection Series.

The most reliable results are obtained in the above test when the dark charge injecting material is condensed on the blocking layer 48 after having been evaporated in a suitable vacuum chamber. Any method of coating such as electrophoretic deposition, solution coating and dip coating can be employed.

As a general rule, materials in the Dark Charge Injection Series will inject charge, in the dark, while subjected to an electric field into any material lower in the series. Some materials can be employed both as dark charge injecting material on the blocking layer as well as a pigment in the imaging system. Hence in some instances the dark charge injecting material need not be higher in the Dark Charge Injection Series than the pigments of imaging layer.

Through experience, the dark charge injection capability of any particular material has been found to be somewhat affected by the time duration of the electric field, the thickness of the dark charge injecting material coating on the blocking layer and the magnitude of the electric field. Generally speaking, the duration of the electric field will give some increase in the amount of dark charge injection but such duration does not appear to be affected in time durations of greater than 1 second. A duration of from $10^{-6}$ seconds to $10^{-1}$ second tends to increase the amount of dark charge injection. In most instances the thickness of the dark charge injecting layer on the blocking electrode is in the range of from about 0.01 to about 10 microns, although other thicknesses can be employed. In general, the amount of dark charge injection increases with increasing thickness but above about 10 microns the amount of dark charge injection increase is small. While it has been found that the amount of the applied field increases the amount of dark charge injection, the amount of injection is generally sufficient for purposes of the photoelectrophoretic imaging process in the range of from about 100 to about 1,000 volts per mil although other fields can be employed. In actual practice, the operating conditions of the above described test are held constant to provide reproducable and comparable results.

DESCRIPTION OF THE PREFERRED EMBODIMENTS

The following examples further specifically define the present invention. Parts and percentages are by weight unless otherwise indicated. The examples are intended to illustrate various preferred embodiments of the process of this invention.

All of the following examples are carried out in an apparatus of the general type illustrated in FIGS. 1*a* and 1*b* with the imaging suspension being coated on the conductive surface of a NESA glass electrode connected in series with a switch, a potential source and a conductive center of a blocking electrode. The roller is about 2½ inches in diameter and is moved across the plate surface at about 4 cm./second in the dark charge injecting step. The conductive electrode employed is roughly a 4 inch square section of NESA glass and is exposed with an unfiltered white light intensity of about 200 microwatts/sq.cm. as measured on the uncoated NESA glass surface. Unless otherwise indicated about 7 percent by weight of the indicated pigments in each example is suspended in Sohio Odorless Solvent 3440 to form the imaging suspension. Exposure is made with a 3200°K lamp through a transparent photographic original. The dark charge injecting layer has a thickness on the blocking electrode in the range of about 0.05 to about 0.1 micron unless otherwise stated.

EXAMPLE I (Prior Art)

An imaging suspension is prepared by adding alphaphthalocyanine to the imaging liquid and coating the suspension onto the surface of a NESA glass electrode. While being exposed imagewise, a blocking electrode is rolled over the suspension with each electrode being connected to a 2,000 volt power supply, the NESA electrode having a positive polarity with respect to the blocking electrode. The blocking material on the roller comprises a 2 mil thick Tedlar film. A positive image having low density is found on the NESA electrode while a low quality negative image having high background is found on the blocking layer.

EXAMPLE II

A dark charge injecting material, Bonadur Red B pigment is suspended in Sohio 3440 at a concentration of about 4 percent. The suspension is painted onto a Tedlar film similar to that of Example I with a small brush. Upon drying, the procedure of Example I is repeated with the exception that the Tedlar film coated with Bonadur Red B pigment is employed as the blocking layer on the roller electrode and the imagewise exposure is omitted. The coated blocking layer is replaced by an uncoated Tedlar film. The roller electrode is again caused to travel across the imaging layer while the layer is being exposed to light with 2,000 volts applied between the electrodes exposure step. A very high density positive image is found on the NESA electrode while an exceptionally high quality negative image is found on the blocking layer. The maximum density of the positive image is found to be 1.8 as compared to the maximum density of 1.1 found in the image of Example I.

EXAMPLE III (Prior Art)

The procedure of Example I is repeated with the exception that yellow pigment, N-2''-pyridyl-8,13-dioxodinaphtho-(2,1-b; 2',3-d)-furan-6-carboxamide) is employed in the imaging suspension. The image produced exhibits a very low maximum density (blue reflection density less than 0.05) while the negative image on the blocking layer indicates high background.

EXAMPLE IV

The procedure of Example III is repeated with the exception a dark charge injecting material is employed on the blocking layer which is 1-[1-naphthyl azo]-2-naphthol and the imagewise exposure step is omitted. This material is evaporated and condensed onto a Tedlar film similar to that employed in Examples I and II. After passing the roller electrode over the imaging suspension, the coated blocking layer is replaced with a clean 2 mil thick Tedlar film. The applied voltage on the electrodes is again adjusted to 2,000 volts and the roller electrode again passed over the dark charged imaging layer while the imaging layer is exposed to light. A positive image is formed on the NESA and a negative image is formed on the blocking layer. The optical density of the image on the conducting electrode is 1.2 (blue reflection). Upon inspection of a negative image on the blocking layer there were found no pigment particles in areas corresponding to maximum density or dark areas of the positive image.

EXAMPLE V

A thin layer of evaporated metal free alpha phthalocyanine is placed on the blocking electrode roller of the imaging apparatus. An imaging suspension is prepared by combining a yellow pigment of Example III whth Sohio Odorless Solvent 3440 and placing it on a NESA glass electrode. With 2,000 volts potential applied, while in the dark, the blocking electrode having the dark charge injecting material coated thereon is rolled over the imaging suspension on the NESA glass plate. A clean blocking electrode is then passed over the dark charged imaging layer while the layer is exposed to light. A dense high quality yellow positive image is found on the NESA electrode while a high quality negative image is found on the blocking electrode.

EXAMPLE VI (Prior Art)

As shown in Example II, Bonadur Red B is a strong dark charge injector. As shown in Table I the dark charge injection ability of the material is affected by the addition of a polymer to the material. An imaging suspension is prepared by combining equal amounts of Bonadur Red B having polymer added as described in Table I with the yellow pigment of Example III. A multicolor original image is employed in the imaging process and the images are found to have poor color separation and low density.

EXAMPLE VII

The procedure of Example VI is repeated with the exception that 1-[1-naphthyl azo]-2-naphthol is condensed on the blocking layer to a thickness of about 0.1 microns and the exposure step is omitted. A clean, uncoated block layer replaces the coated layer and the applied voltage adjusted to 2,000 volts. The roller electrode with the clean blocking layer is passed over the dark charged layer while the layer is exposed to light. Good color separation and high density is achieved.

EXAMPLE VIII (Prior Art)

A trimix imaging suspension is prepared by combining equal amount of polymer added Bonadur Red B of Example VI, the yellow pigment of Example III and metal free alpha phthalocyanine, which has had polymer added as with the Bonadur Red B pigment. A full color transparency is employed in the imaging system resulting in the production of low density full color images on the electrodes having poor color separation.

EXAMPLE IX

The procedure of Example VIII is repeated with the exception that a thin layer of 1-[1-naphthyl azo]-2-naphthol is condensed on the blocking electrode and the imagewise exposure step is omitted. The coated blocking layer is replaced with a clean Tedlar film and the voltage applied to the electrodes adjusted to 2,000 volts. Full color optical positive and negative images are provided on the electrodes which are characterized by high density and good color separation.

EXAMPLE X

The procedure of Example VIII is repeated with the exception that Bonadur Red B Pigment, without polymer addition, is added to the trimix in the amount of about 10 percent by weight of the trimix pigments. Also, the amount of magenta pigment in the trimix is reduced slightly. Upon application of the electric field most of the Bonadur Red B pigment without polymer migrates to the blocking electrode thus forming a dark charge injecting layer on the blocking layer. Upon exposure an image is formed on the conductive electrode which has high density and good color balance.

EXAMPLE XI

The procedure of Example IX is repeated with the exception that a full color negative transparency is employed as an original. Upon completion of the imaging procedure a high quality full color positive of the original is found on the blocking electrode and a negative of the original is found on the conductive electrode.

The following Table II lists other examples of dark charge injecting materials employed in the above-described photoelectrophoretic imaging process employing an imaging suspension containing the specified pigments.

TABLE II

| Example | Dark Charge Injecting Material | Imaging Suspension Pigments |
|---|---|---|
| XII | Indofast Yellow Tones (available from Harmon Color Co.) | Bonadur Red B, metal |

TABLE II-continued

| Example | Dark Charge Injecting Material | Imaging Suspension Pigments |
|---|---|---|
| | | free alpha phthalocyanine, yellow pigment of Example III |
| XIII | Naphtho [2,3-d] furo-[3,2-f] quinoline-8,13-dione | " |
| XIV | Rhodamine B (ionic dye) | " |
| XV | benzo-[b]-naphtho-[2,3-d] furan-6,11-dione | " |
| XVI | same | Yellow pigment of Example III |
| XVII | Rhodamine B (ionic dye) | " |
| XVIII | Indofast Yellow Toner | " |
| XIX | 1-[p-nitrophenyl azo]-2-naphthol | " |
| XX | Hexadecyl amine | " |
| XXI | Hexadecyl amine hydrochloride | " |
| XXII | Hexadecyl trimethyl ammonium chloride | " |
| XXIII | p-nitrophenol | " |
| XXIV | Hexadecyl alcohol | " |
| XXV | p-dimethylaminoazobenzene | " |
| XXVI | Erythrosine Yellowish $C_{20}H_8I_2Na_2O_5$ | " |
| XXVII | Potassium Iodide | " |
| XXVIII | Lithium Bromide | " |
| XXIX | Lithium chloride | " |
| XXX | Ferrous chloride | " |
| XXXI | Dodecylethylmethylsulfonium chloride | " |
| XXXII | Hexadecyltrimethylammonium chloride | " |
| XXXIII | Polyvinylbenzyl trimethyl ammonium | " |
| XXXIV | Alkyl aryl sulfonate (Atlas G3300) (available from Atlas Chemical Co.) | " |
| XXXV | N-cetyl-Nethyl morpholinium ethosulfate (Atlas G263) | " |
| XXXVI | Dodecylphenol ethylene oxide adduct (Monsanto Sterox DF) Available from Monsanto Co. | Yellow pigment of Example III |
| XXXVII | Dodecyl phenol | " |
| XXXVIII | Arginine | " |
| XXXIX | 8-hydroxy quinoline | " |
| XL | Benzotriazole | " |
| IXL | Carbon Black | " |
| VIIIL | Cobalt neodecanoate | " |

Although specific components and proportions have been stated in the above description of preferred embodiments of the invention, other typical materials as listed above if suitable may be used with similar results. In addition, other materials may be added to the mixture to synergize, enhance or otherwise modify the properties of the imaging layer. For example, various dyes, spectral sensitizers such as Lewis acids may be added to the several layers.

Other modifications and ramifications of the present invention will occur to those skilled in the art upon a reading of the present disclosure. These are intended to be included within the scope of this invention.

What is claimed is:

1. A photoelectrophoretic imaging process comprising the steps of providing an imaging layer comprising a suspension of electrically photosensitive pigment particles in an electrically insulating liquid placed between an electrically conductive electrode and a first blocking electrode, said conductive electrode being at least partially transparent to electromagnetic radiation to which at least a portion of said pigment particles are sensitive and said first blocking electrode being coated with a dark charge injecting agent, said dark charge injecting agent on said first blocking electrode being capable of causing said pigment particles to be substantially uniformly attracted to said conductive electrode when an electrical field is applied across said suspension in the dark between said conductive electrode and said first blocking electrode, subjecting said suspension to a first electrical field established between said conductive electrode and said first blocking electrode in the dark while in contact with said dark charge injecting agent whereby said pigment particles are substantially uniformly deposited on said conductive electrode, subjecting said imaging layer to a second electrical field established between said conductive electrode and a second blocking electrode free of said dark charge injecting agent while exposing said suspension to electromagnetic radiation to which at least a portion of said pigment particles are sensitive until an image is formed.

2. The method of claim 1 wherein said imaging suspension comprises particles of pigments of at least two colors and having different spectral sensitivity.

3. The method of claim 1 wherein said imaging suspension comprises particles of three different electrically photosensitive pigments each pigment being responsive to a different wavelength of electromagnetic radiation.

4. The method of claim 1 wherein the imaging suspension includes cyan colored particles which are principally photo-sensitive to red light, magenta colored particles which are principally photosensitive to green light, and yellow colored particles which are principally photosensitive to blue light.

5. The method of claim 1 wherein said dark charge injecting agent is first coated on said first blocking electrode and fixed thereto before being placed in contact with said imaging layer.

6. The method of claim 1 wherein the dark charge injecting agent is initially included in said imaging layer in addition to said electrically photosensitive pigment particles and said dark charge injecting agent is attracted to said first blocking electrode, by the application of said first electrical field while said imaging layer is held in the dark condition.

7. The method of claim 1 wherein the second electrical field is different than said first field.

8. The method of claim 7 wherein the first electrical field is in the range of from about 100 volts per mil to about 1,000 volts per mil.

9. The method of claim 8 wherein the second electrical field is in the range of from about 200 volts per mil to about 1,200 volts per mil.

10. The method of claim 5 wherein said dark charge injecting agent is vacuum evaporated onto said first blocking electrode.

11. The method of claim 5 wherein said dark charge injecting agent is coated onto said first blocking electrode from a liquid dispersion.

12. The method of claim 5 wherein said first blocking electrode is coated with said dark charge injecting agent by dipping said first blocking electrode into a suspension of said dark charge injecting agent.

13. The method of claim 1 wherein the dark charge injecting coating has a thickness in the range of from about 0.01 micron to about 10 microns.

14. The method of claim 1 wherein the dark charge injecting agent is Bonadur Red B.

15. The method of claim 1 wherein the dark charge injecting agent 1-[1-naphthyl azo]-2-naphthol.

16. The method of claim 1 wherein the dark charge injecting agent is selected from the group consisting of benzo-[b]-naphtho-[2,3-d] furan-6,11 dione, naphtho [2,3-d] furo-3,2-f] quinoline-8,13 dione, naphtho [2,3-d] furo-[2,3-h] quinoline-8,13 dione, dinaphtho [1,2,b;2',3'd] furan-7,12 dione, and dinaphtho [1,2b;2',3'd] furan-8,13 dione.

17. The method of claim 1 wherein the dark charge injecting agent is Rhodamine B.

18. The method of claim 1 wherein the imaging suspension is exposed to an optically negative image thereby providing an optically positive copy on said second blocking electrode.

19. The method of claim 18 wherein said imaging suspension comprises particles of three different electrically photosensitive pigments, each pigment being responsive to a different wavelength of electromagnetic radiation.

20. The method of claim 19 wherein the imaging suspension includes cyan colored particles which are principally photosensitive to red light, magenta colored particles which are principally photosensitive to green light, and yellow colored particles which are principally photosensitive to blue light.

21. The method of claim 18 wherein the dark charge injecting agent is 1-[1-naphthyl azo]-2-naphthol.

22. The method of claim 1 wherein at least one of said blocking electrodes is in the form of a roller.

* * * * *